US009437989B2

(12) United States Patent
Hsu

(10) Patent No.: US 9,437,989 B2
(45) Date of Patent: Sep. 6, 2016

(54) PLUG FOR ELECTRICALLY MATING WITH A RECEPTACLE

(71) Applicant: Yong Tai Electronic(DONGGUAN) Ltd., Dongguan (CN)

(72) Inventor: Ching-Jen Hsu, Dongguan (CN)

(73) Assignee: YONG TAI ELECTRONIC (DONGGUAN) LTD., Dongguan (CN)

( * ) Notice: Subject to any disclaimer, the term of this patent is extended or adjusted under 35 U.S.C. 154(b) by 0 days.

(21) Appl. No.: 14/849,750

(22) Filed: Sep. 10, 2015

(65) Prior Publication Data

US 2016/0141803 A1 May 19, 2016

(30) Foreign Application Priority Data

Nov. 16, 2014 (CN) ..... 2014 2 0690153 U
Dec. 31, 2014 (CN) ..... 2014 2 0869995 U

(51) Int. Cl.

| | |
|---|---|
| ***H01R 13/648*** | (2006.01) |
| ***H01R 24/60*** | (2011.01) |
| ***H01R 13/6585*** | (2011.01) |
| *H01R 13/6581* | (2011.01) |
| *H01R 13/6593* | (2011.01) |
| *H01R 13/58* | (2006.01) |

(52) U.S. Cl.

CPC ..... *H01R 24/60* (2013.01); *H01R 13/6585* (2013.01); *H01R 13/5825* (2013.01); *H01R 13/6581* (2013.01); *H01R 13/6593* (2013.01)

(58) Field of Classification Search

USPC ..... 439/607.54, 607.55

See application file for complete search history.

(56) References Cited

U.S. PATENT DOCUMENTS

| | | | | |
|---|---|---|---|---|
| 5,934,939 | A * | 8/1999 | Thenaisie | H01R 13/627 439/108 |
| 6,926,557 | B1 * | 8/2005 | Yamaguchi | H01R 12/7064 439/607.54 |
| 7,695,304 | B2 * | 4/2010 | Chiang | H01R 13/506 439/353 |
| 2011/0034061 | A1 * | 2/2011 | Wu | H01R 13/648 439/345 |
| 2016/0013595 | A1 * | 1/2016 | Kao | H01R 13/6591 439/607.55 |
| 2016/0099524 | A1 * | 4/2016 | Hack | H01R 43/16 439/607.55 |

* cited by examiner

*Primary Examiner* — Tho D Ta

(74) *Attorney, Agent, or Firm* — WPAT, PC; Justin King

(57) ABSTRACT

A plug comprises a plurality of top contacts embedded in a top insulator, a shielding sheet, a plurality of bottom contacts embedded in a bottom insulator, a front insulator configured to receive every cantilever of the contacts, and a front conductive shell including a base and a sheath. The top insulator, the bottom insulator and the front insulator are coupled together while the shielding sheet is wedged between the top insulator and the bottom insulator. The base protrudes outward to form a shoulder between the base and the sheath. The sheath substantially fits closely around the front insulator. The front insulator has a front edge concaved backward while the sheath has a front edge convexed backward in order to engage with the front edge of the front insulator.

19 Claims, 15 Drawing Sheets

PLUG FOR ELECTRICALLY MATING WITH A RECEPTACLE

CROSS-REFERENCE TO RELATED APPLICATIONS

The present application claims the benefit of priority to Chinese patent application No. 201420690153.9, filed Nov. 16, 2014 and entitled "Receptacle Connector" as well as Chinese patent application No. 201420869995.0, filed Dec. 31, 2014 and entitled "Electrical Connector", the disclosures of which are hereby incorporated by reference in their entirety.

FIELD OF THE INVENTION

The present invention generally relates to a plug connector, and more particularly to a plug having a shielding sheet.

BACKGROUND OF THE INVENTION

Universal Serial Bus (USB) interfaces are commonly used in a variety of applications for connecting two electronic devices. The design of USB is standardized by the USB Implementers Forum (USB-IF), which has released a USB Type C Specification on Aug. 11, 2014 in order to meet requirements of high-speed, miniaturization and high-capacity. Under the circumstances, connectors with high frequency, compact design and excellent reliability are craved.

SUMMARY OF THE PRESENT INVENTION

According to the present invention, a plug with high frequency, compact design and excellent reliability is provided.

To achieve the above objectives, one particular embodiment of the invention pertains to a plug for electrically mating with a receptacle. The plug comprises a plurality of top contacts, a shielding sheet, a plurality of bottom contacts, a front insulator and a front conductive shell. The plurality of top contacts is embedded in a top insulator. Two retention latches respectively extend from both sides of the shielding sheet. The plurality of bottom contacts is embedded in a bottom insulator.

Each of the plurality of top contacts has a top cantilever and a top leg respectively protruding forward and backward from the top insulator. Each of the plurality of bottom contacts has a bottom cantilever and a bottom leg respectively protruding forward and backward from the bottom insulator. The front insulator is configured to receive every top cantilever every bottom cantilever.

The top insulator, the bottom insulator and the front insulator are coupled together while the shielding sheet is wedged between the top insulator and the bottom insulator. The front conductive shell includes a base and a sheath. The base protrudes outward to form a shoulder between the base and the sheath. The sheath substantially fits closely around the front insulator. Two ground pieces are respectively disposed on a top niche and a bottom niche of the front insulator. The two ground pieces are electrically connected to the sheath. The front insulator has a front edge concaved backward while the sheath has a front edge convexed backward in order to engage with the front edge of the front insulator.

Other objects, advantages and novel features of the invention will become readily apparent from the following detailed description when taken in conjunction with the accompanying drawings.

DETAILED DESCRIPTION OF THE INVENTION

Figure 1:
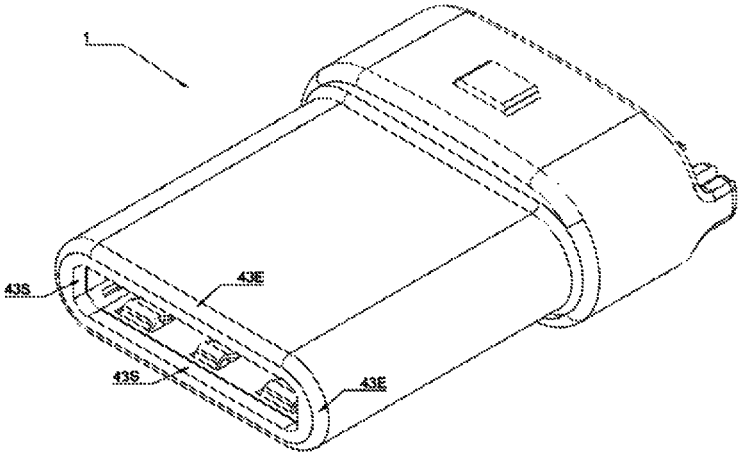
FIG. 1 is a perspective view of a plug according to an embodiment of the present invention.

The present invention will now be described in detail with reference to embodiments thereof as illustrated in the accompanying drawings. While same or similar reference numerals or characters designate like parts or elements in different figures, doing so does not mean figures including same or similar reference numerals or characters constitute a single or same embodiment.

Figure 2:
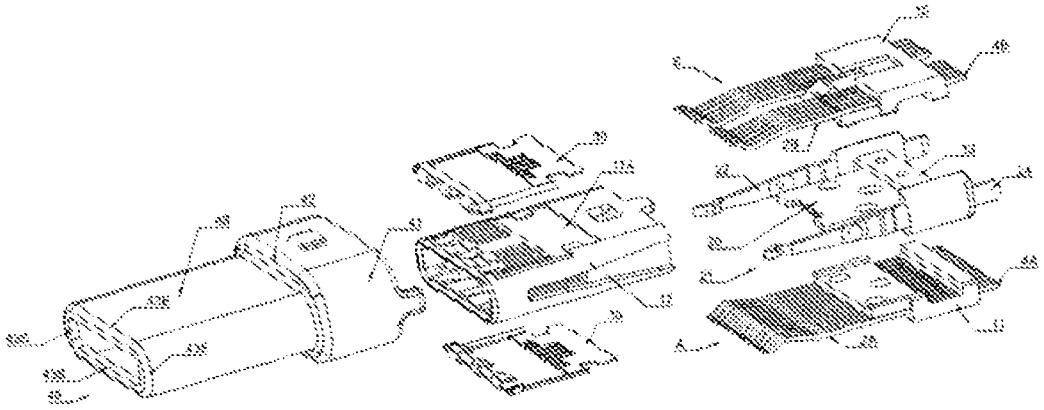
FIG. 2 is an exploded view of a plug according to an embodiment of the present invention.

In order to better appreciate and understand the present invention, reference is first made to FIGS. 1-2, which are perspective and exploded views, respectively, of a plug 1 according to an embodiment of the present invention. It is worthwhile mentioning that the plug 1 is turned upside down in FIG. 2. The plug 1 is provided for electrically mating with a receptacle (not shown) and comprises a plurality of top contacts A, a shielding sheet 20, a plurality of bottom contacts B, a front insulator 17 and a front conductive shell 40.

The plurality of top contacts A is embedded in a top insulator 11 while the plurality of bottom contacts B is embedded in a bottom insulator 15. In comparison, the shielding sheet 20 is embedded in a mid-insulator 13. Furthermore, each of the plurality of top contacts A has a top cantilever 2A and a top leg 4A respectively protruding forward and backward from the top insulator 11. Similarly, each of the plurality of bottom contacts B has a bottom cantilever 2B and a bottom leg 4B respectively protruding forward and backward from the bottom insulator 15.

Figure 3:
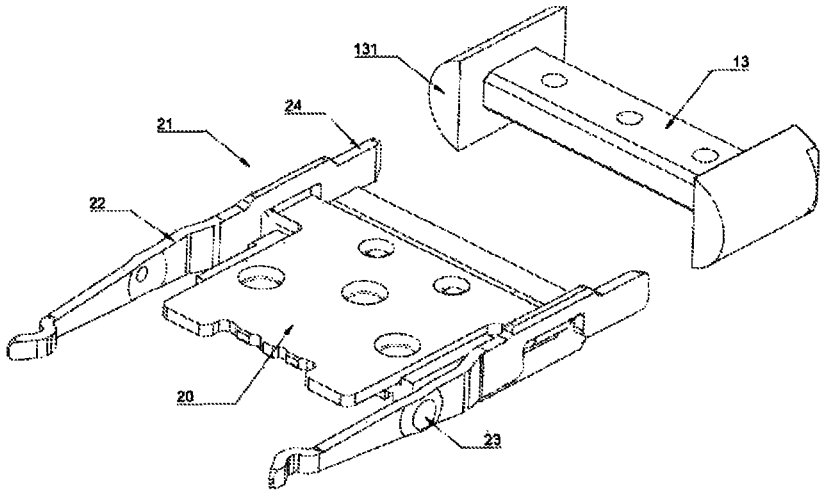
FIG. 3 is a perspective view of a mid-insulator before molding to a shielding sheet according to an embodiment of the present invention.

Reference is now made to FIG. 2 as well as FIG. 3, which is a perspective view of the mid-insulator 13 before being molded to the shielding sheet 20 according to an embodiment of the present invention. Two retention latches 21 respectively extend from both sides of the shielding sheet 20. The two retention latches 21 are perpendicular to the shielding sheet 20. Where the two retention latches 21 are linked to the shielding sheet 20 is encapsulated in two reinforced portions 131 of the mid-insulator 13, both the top insulator 11 and the bottom insulator 15 are wedged between the two reinforced portions 131. The two retention latches 21 are adapted to engage with two notches (not shown) in the receptacle. Each of the two retention latches 21 has a lateral cantilever 22 and a lateral leg 24 respectively protruding forward and backward from the two reinforced portions 131 of the mid-insulator 13. Each lateral cantilever 22 is embossed with a bulge 23 electrically connected to the sheath 43, as described in detail later.

Figure 4:
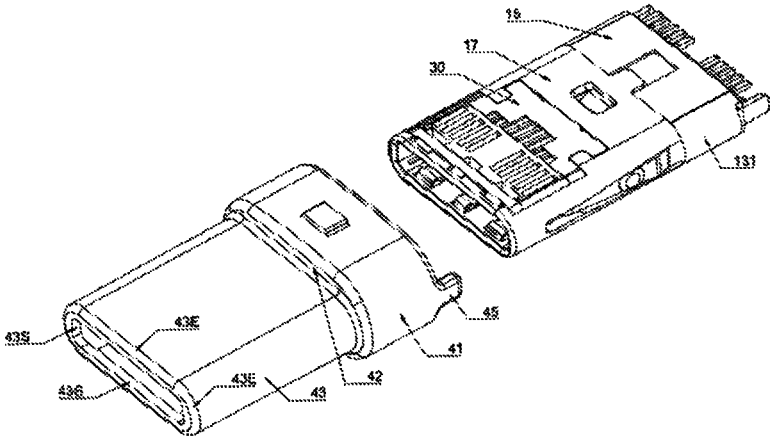
FIG. 4 is a perspective view of a plug before being covered with a front conductive shell according to an embodiment of the present invention.

Reference is then made to FIG. 2 along with FIG. 4, which is a perspective view of the plug 1 before being covered with the front conductive shell 40 according to an embodiment of the present invention. The top insulator 11 (not shown), the bottom insulator 15 and the front insulator 17 are coupled together while the mid-insulator 13 is wedged between the top insulator 11 and the bottom insulator 15. The front insulator 17 is configured to receive every top cantilever 2A, every lateral cantilever 22, every bottom cantilever 2B and a tongue (not shown) of the receptacle. Two ground pieces 30 are respectively disposed on a top niche (not shown) and a bottom niche 174 of the front insulator 17. The front conductive shell 40 includes a base 41 and a sheath 43. The base 41 protrudes outward from a rear portion of the sheath 43 to form a shoulder 42 between the base 41 and the sheath 43.

Figure 5:
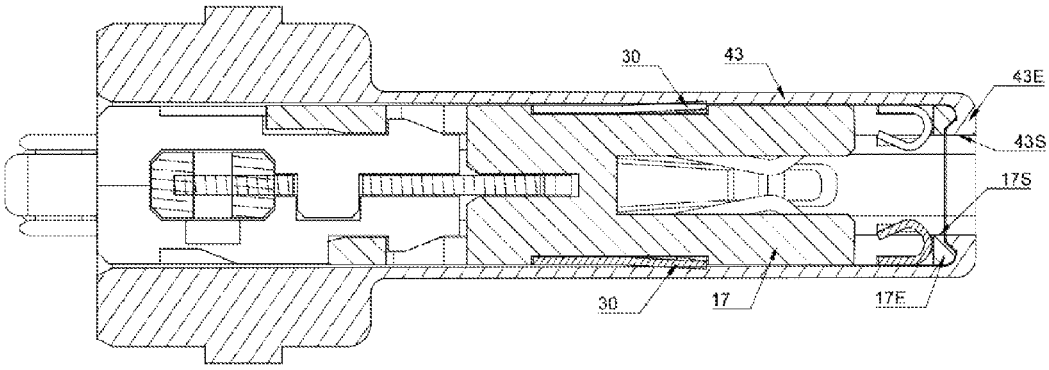
FIG. 5 is a cross-sectional view of a plug taken along a symmetrical plane that is parallel to a length of a sheath and bisects a width thereof according to an embodiment of the present invention.
Figure 6:
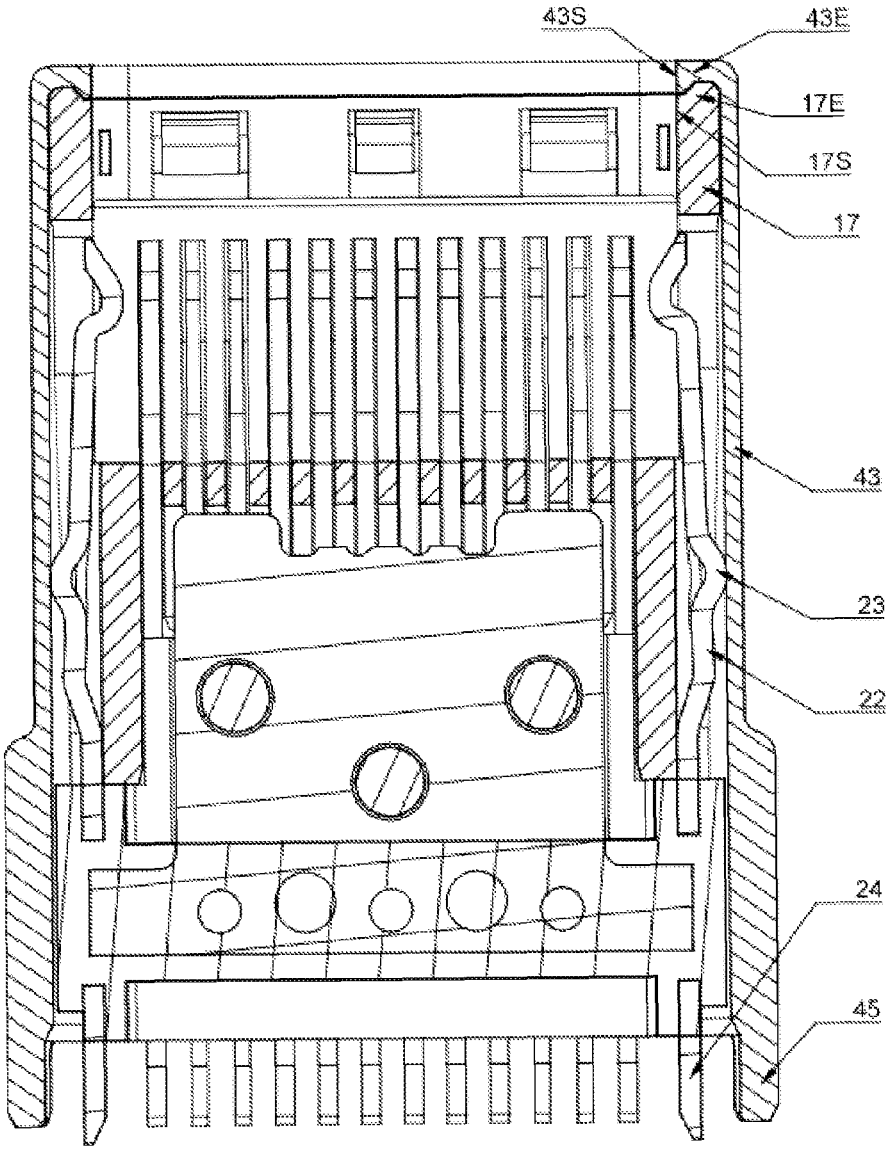
FIG. 6 is another cross-sectional view of a plug taken along another symmetrical plane that is parallel to a length of a sheath and bisects a height thereof according to an embodiment of the present invention.

Reference is now made to FIGS. 5-6, which are cross-sectional views of the plug 1 taken along symmetrical planes that are parallel to a length of the sheath 43 and respectively bisects a width and a height thereof according to an embodiment of the present invention. As can be seen, the sheath 43 substantially fits closely around the front insulator 17, the bottom insulator 15, the mid-insulator 13 and the top insulator 11 substantially from head to toe without surrounding the top legs 4A and the bottom legs 4B. Two tabs 45 parallel and adjacent to the two lateral legs 24 extend away from a rear edge of the front conductive shell 40. Both the bulge 23 and the two ground pieces 30 are electrically connected to the sheath 43. It is worthwhile mentioning that the front insulator 17 has a front edge 17E concaved backward while the sheath 43 has a front edge 43E convexed backward, with the result that the front edge 43E engages with the front edge 17E. Both the front edge 17E and the front edge 43E are seamless. Also noteworthy is that an internal surface 43S of the front edge 43E is substantially even with an internal surface 17S of the front edge 17E.

Figure 7:
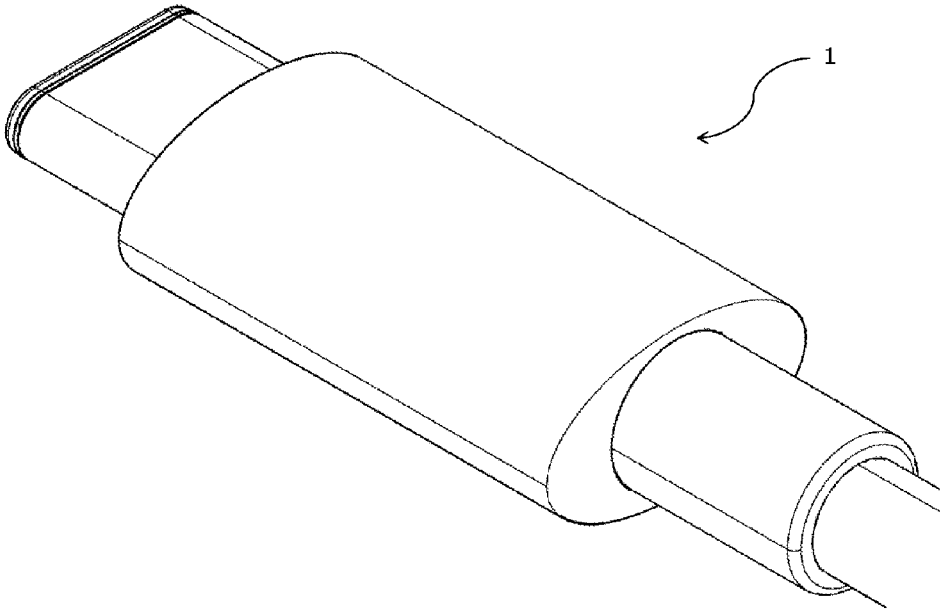
FIG. 7 is a perspective view of a plug according to an embodiment of the present invention.
Figure 8:
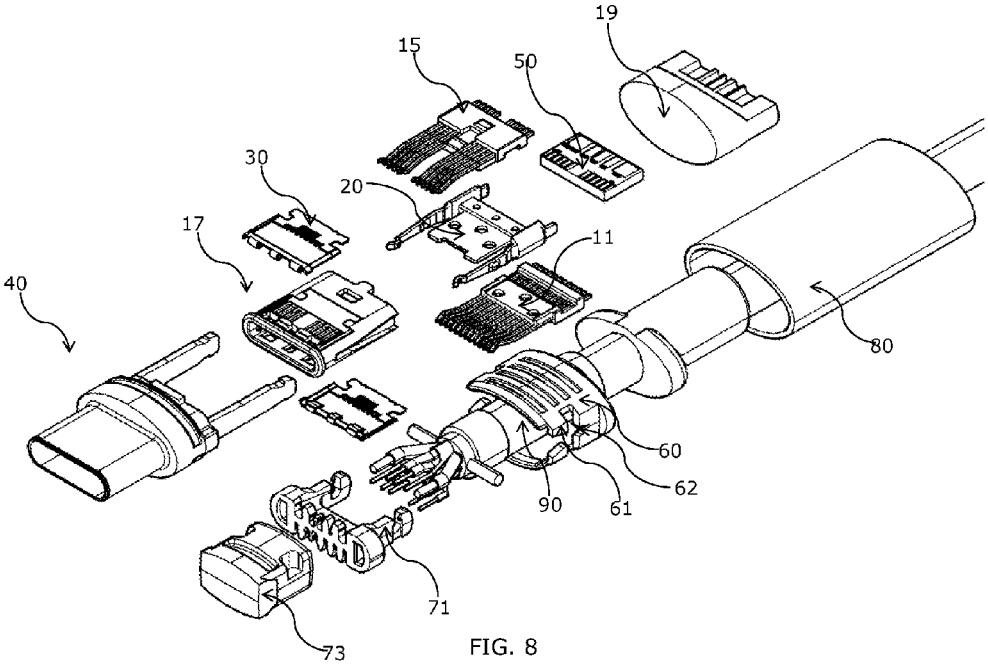
FIG. 8 is an exploded view of a plug placed upside down according to an embodiment of the present invention.

FIGS. 7-8 are perspective and exploded views, respectively, of the plug 1 according to an embodiment of the present invention. It is to be noted that the plug 1 in FIG. 8 is placed upside down. The plug 1 further comprises a paddle card 50, a rear insulator 19, a disparting rack 71, a filler 73, an inner conductive shell 60, a rear conductive shell 80 and a cable 90.

Figure 9A:
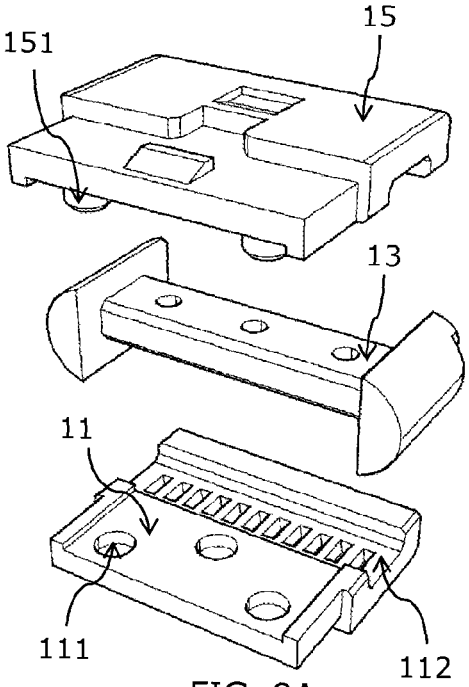
FIGS. 9A and 9B are upside down and normal views of a top insulator, a mid-insulator and a bottom insulator according to an embodiment of the present invention.
Figure 9B:
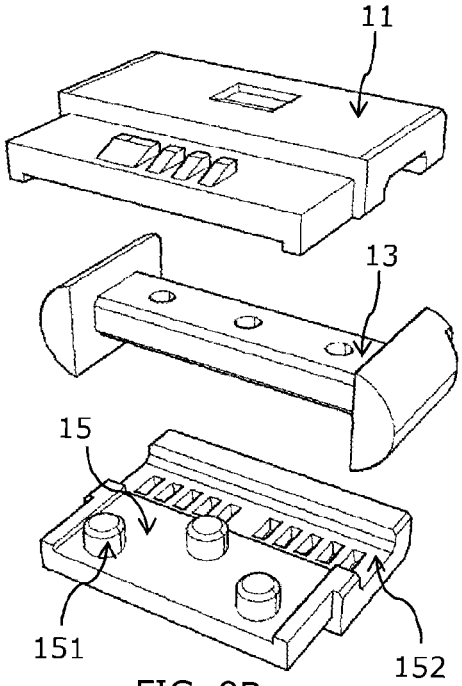

FIGS. 9A and 9B are upside down and normal views, respectively, of the top insulator 11, the mid-insulator 13 and the bottom insulator 15 according to an embodiment of the present invention. Three tenons 151 of the bottom insulator 15 is coupled to three corresponding mortises 111 of the top insulator 11 as the mid-insulator 13 is wedged between two trenches 112 & 152 respectively formed on the top insulator 11 and the bottom insulator 15. By the mid-insulator 13, the shielding sheet 20 is indirectly wedged between the top insulator 11 and the bottom insulator 15 in this embodiment, but may be directly wedged without the mid-insulator 13 in other embodiments.

Figure 10A:
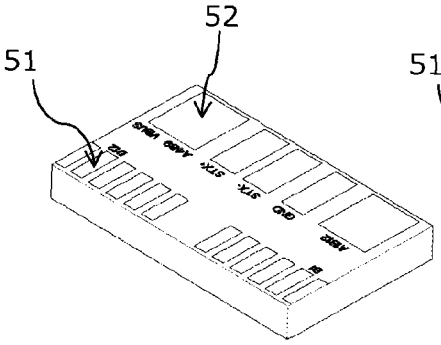
FIGS. 10A and 10B are upside down and normal views of a paddle card according to an embodiment of the present invention.
Figure 10B:
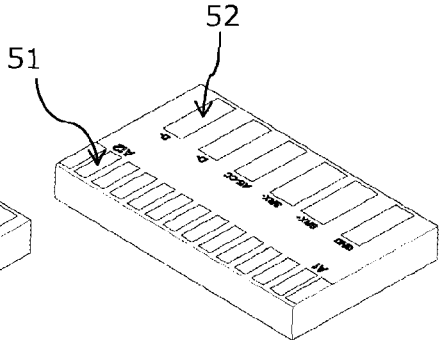

FIGS. 10A and 10B are upside down and normal views, respectively, of the paddle card 50 according to an embodiment of the present invention. A plurality of front solder pads 51 for the top legs 4A and the bottom legs 4B as well as a plurality of rear solder pads 52 for a plurality of wires in the cable 90 are provided both on the top and bottom surfaces of the paddle card 50. That is, the top legs 4A and the bottom legs 4B are mounted onto the plurality of front solder pads 51 both on the top and bottom surfaces of the paddle card 50. In comparison, the plurality of wires 91 are soldered onto the plurality of rear solder pads 52 both on the top and bottom surfaces of the paddle card 50.

Figure 11A:
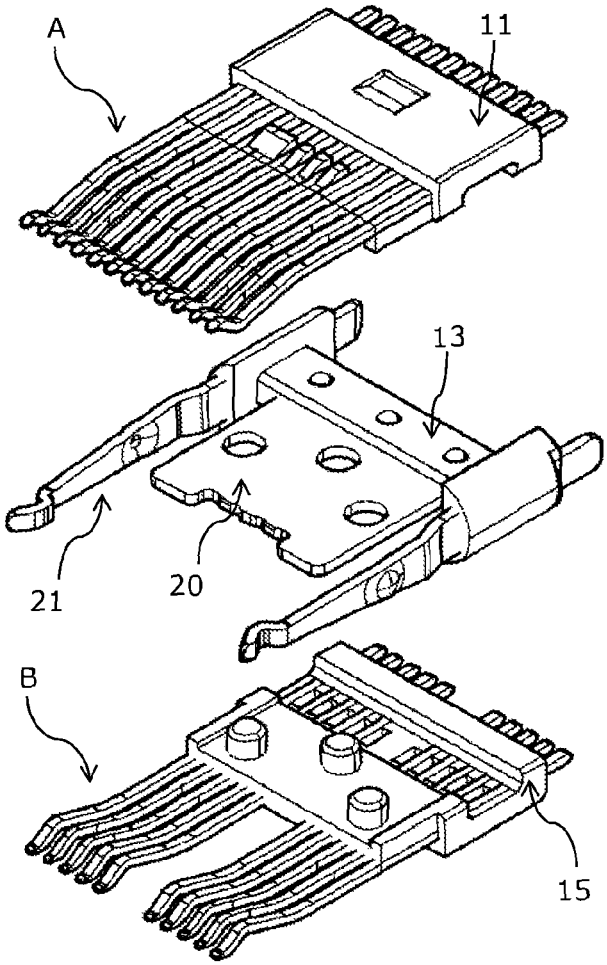
FIGS. 11A-11K depicts various views of a plug at different stages of manufacture according to an embodiment of the present invention.
Figure 11B:
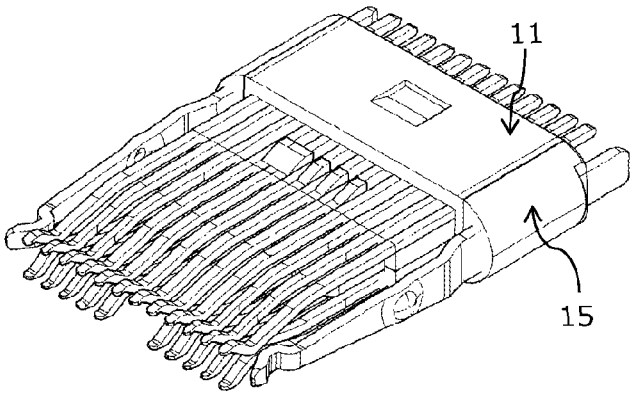

Reference is last made to FIGS. 11A-11K, which depicts various views of the plug 1 at different stages of manufacture according to an embodiment of the present invention. In FIGS. 11A-11B, the top insulator 11 and the bottom insulator 15 are respectively molded to the plurality of top contacts A and the plurality of bottom contacts B, which are respectively spaced apart along a top row and a bottom row. Similarly, the mid-insulator 13 solidifies around the shielding sheet 20 along with the two retention latches 21 during insert molding. The relative positions of the plurality of top contacts A, the shielding sheet 20 and the plurality of bottom contacts B mainly depend upon the configurations of the top insulator 11, the mid-insulator 13 and the bottom insulator 15. For example, both the length of the three tenons 151 and the depth of the tree mortise determine the distance between the top and bottom rows.

Figure 11C:
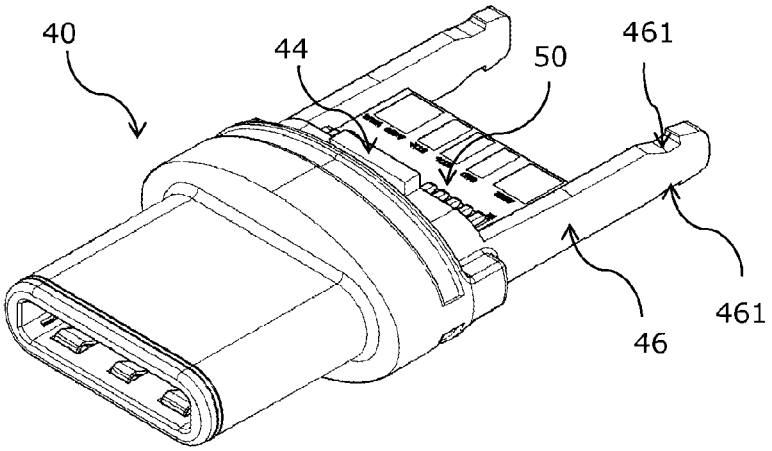
Figure 11D:
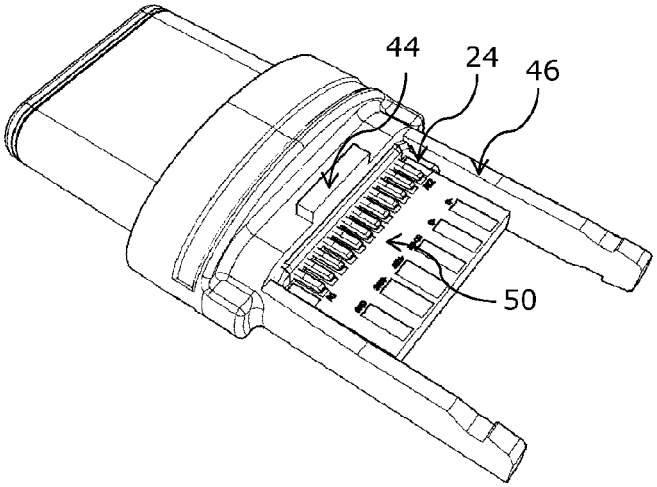
Figure 11E:
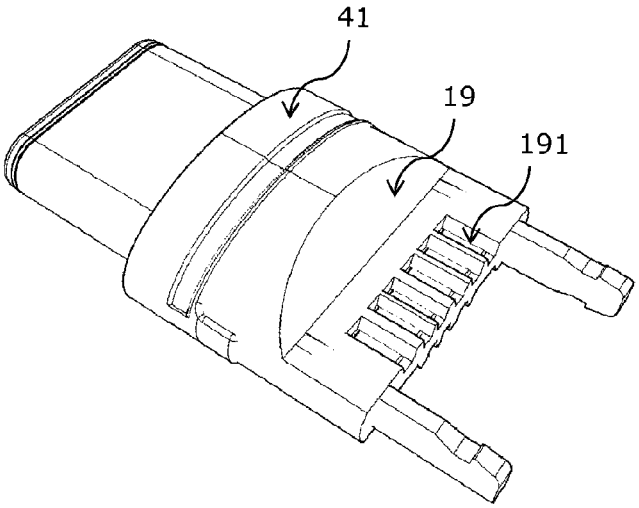

Now referring to FIGS. 11C-11E, the front conductive shell 40 further includes two arms 46 that are respectively next to the two lateral legs 24 and located at both sides of the paddle card 50. The two arms 46 extend away from the front conductive shell 40 backward until the two arms 46 are coupled to the inner conductive shell 60 by two pairs of notches 461, as will be described in detail later. The two pairs of notches 461 are respectively located at somewhere near free ends of the two arms 46. Moreover, a rear part of the base 41, part of the two arms 46 and part of the paddle card 50 especially where the top legs 4A and the bottom legs 4B are coupled to are encapsulated in the rear insulator 19. In contrast, a plurality of solder cups 191 are integrally formed on the rear insulator 19 so as to expose the plurality of rear solder pads 52. The rear insulator 19 is coupled to the base 41 by a tenon 44 integrally formed on the base 41 in this embodiment, but alternatively by a mortise, a flange, a trench, or the like in other embodiments.

Figure 11F:
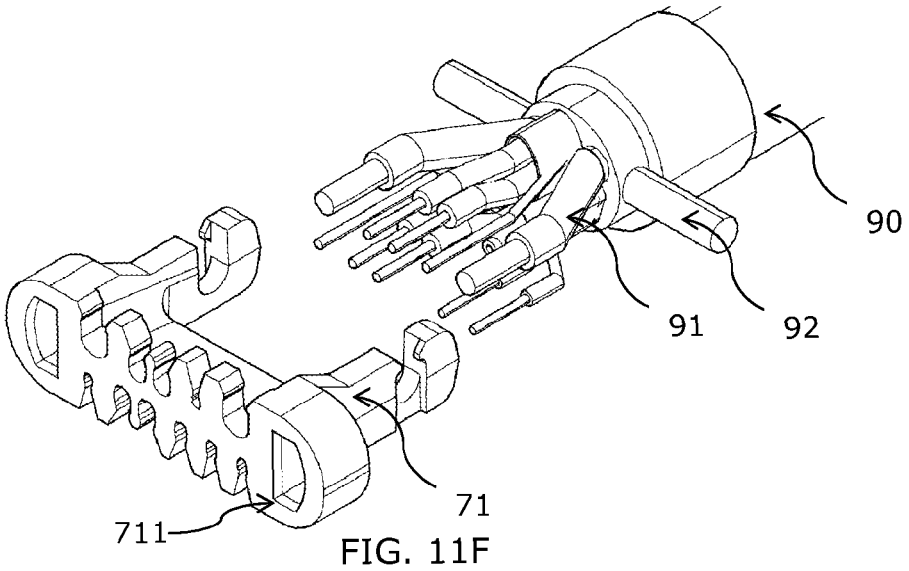
Figure 11G:
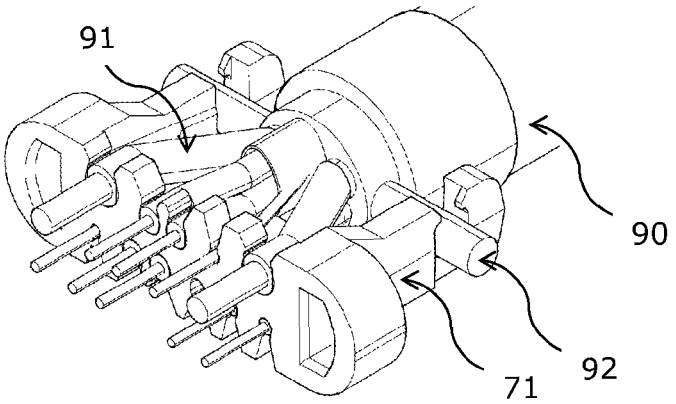
Figure 11H:
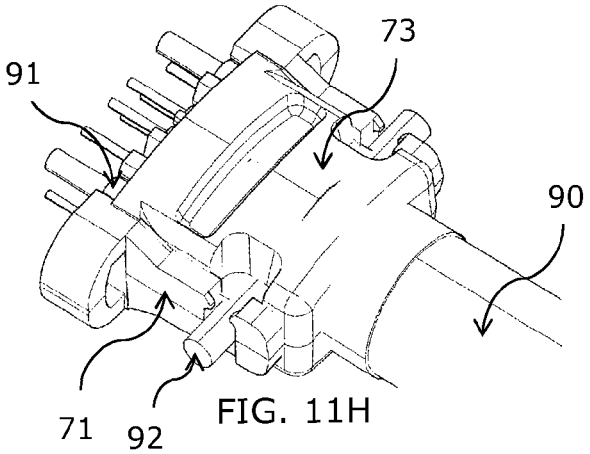

FIGS. 11F-11G shows how a shield 92 and the plurality of wires 91 in the cable 90 are separated by and rested against the disparting rack 71. The shield 92, which can be a copper or aluminum braided shield, is twisted in two bunches and arranged at both sides of the disparting rack 71. The disparting rack 71 further comprises two collars 711 for holding the two arms 46, as described in detail below. FIG. H further demonstrates that where the plurality of wires 91 are supported and overlapped by the disparting rack 71 is considerably encapsulated in the filler 73.

Figure 11I:
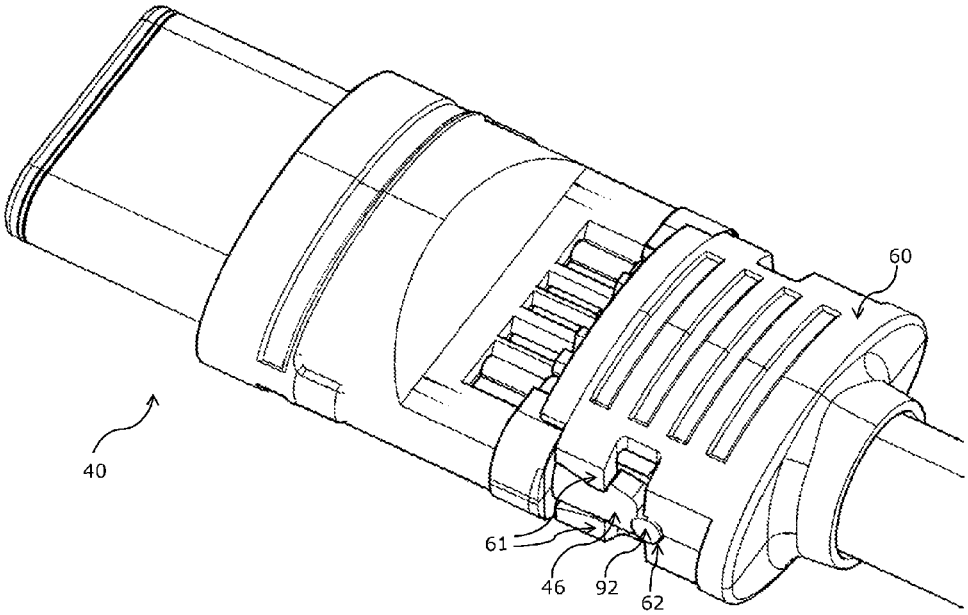
Figure 11J:
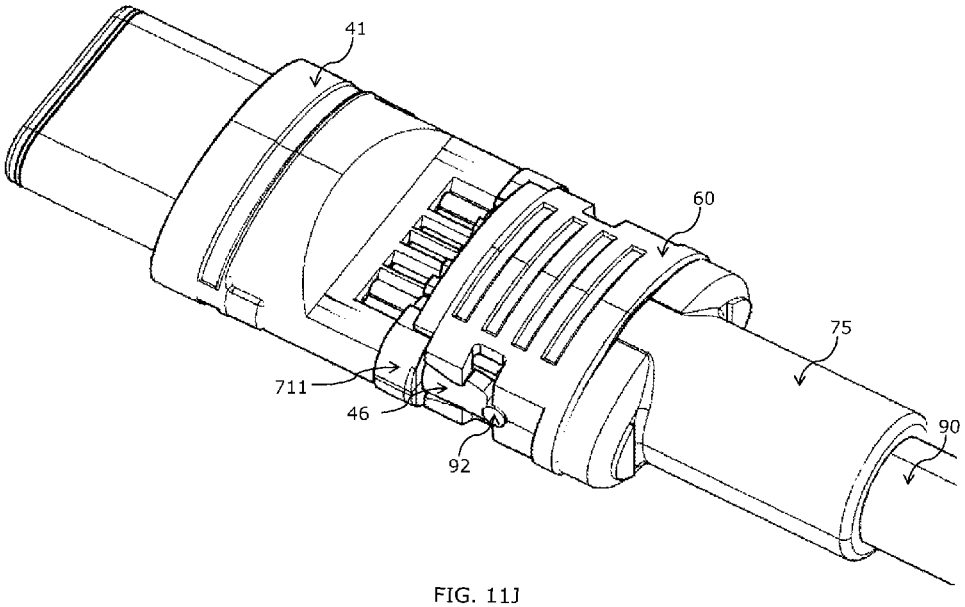
Figure 11K:
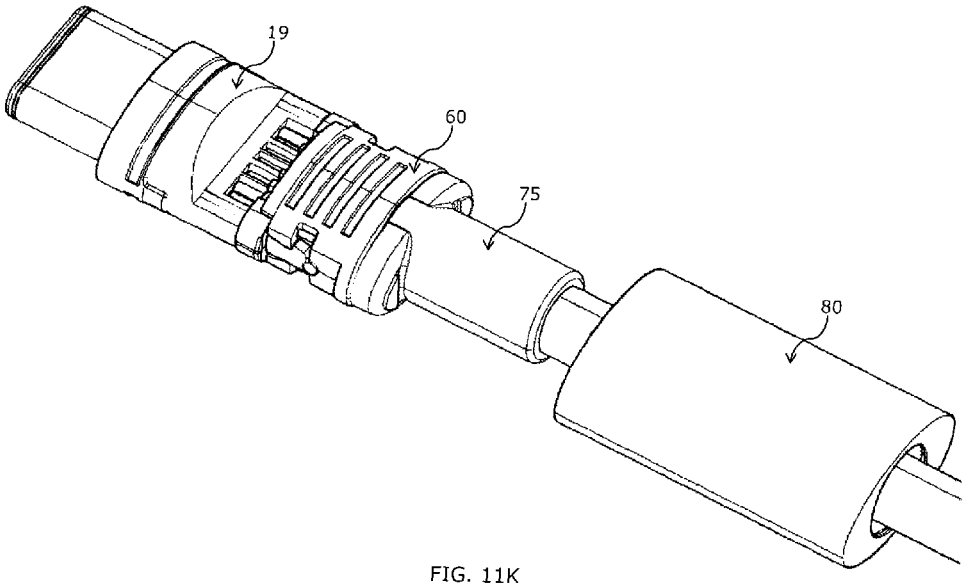

FIGS. 11I-11K depicts the plug 1 at last stages of manufacture. When being wrapped around the filler 73 and the disparting rack 71, the inner conductive shell 60 is coupled to the front conductive shell 40, with the result that the shield 92 is urged into engagement with both the front conductive shell 40 and the inner conductive shell 60. Specifically, the two pairs of notches 461 (shown in FIG. 11C) mate with two pairs of latches 61 formed on and located at both sides of the inner conductive shell 60. When the free ends of the two arms 46 pass through the two collars 711 and are then inserted into the inner conductive shell 60, the two pairs of latches 61 will be engaged with the two pairs of notches 461. Following this, the two bunches of the shield 92 are consequently pinched between front edges of the two arms 46 and two vacancies 62 of the inner conductive shell 60. Meanwhile, front tips of the plurality of wires 91 are placed into the plurality of solder cups 191 and later mounted onto the plurality of rear solder pads 52 by soldering. Following this, a strain relief 75 is formed onto the cable 90 together with a rear part of the inner conductive shell 60. Finally, the rear conductive shell 80 is installed from behind and coupled to the base 41. Consequently, the base 41, the rear insulator 19, the inner conductive shell 60 and a front part of the strain relief 75 are substantially covered with the rear conductive shell 80, as shown in FIG. 7. It is worthwhile mentioning that the rear conductive shell 80 is made seamless by die casting zinc alloy into one piece.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. All directional references (e.g., front, rear, side, top, bottom) are only used for identification purposes to aid the reader's understanding of the embodiments of the present invention, and do not create limitations, particularly as to the position, orientation, or use of the invention unless specifically set forth in the claims. Joinder references (that is, coupled, connected and the like) are to be construed broadly and may include relative movement between elements and intermediate members between a connection of elements. As such, joinder references do not necessarily infer that two elements are directly connected and in fixed relation to each other.

What is claimed is:

1. A plug for electrically mating with a receptacle, comprising:

a plurality of top contacts embedded in a top insulator, wherein each of the plurality of top contacts has a top cantilever and a top leg respectively protruding forward and backward from the top insulator;

a shielding sheet, from both sides of which two retention latches respectively extend;

a plurality of bottom contacts embedded in a bottom insulator, wherein each of the plurality of bottom contacts has a bottom cantilever and a bottom leg respectively protruding forward and backward from the bottom insulator;

a front insulator configured to receive every top cantilever and every bottom cantilever and provided with a front opening for the receptacle to be correspondingly inserted in, two ground pieces respectively disposed on a top niche and a bottom niche of the front insulator, wherein the top insulator, the bottom insulator and the front insulator are coupled together while the shielding sheet is wedged between the top insulator and the bottom insulator; and a front conductive shell including a base and a sheath, the base protruding outward to form a shoulder between the base and the sheath, the sheath substantially fitting closely around the front insulator, the two ground pieces electrically connected to the sheath, wherein the front insulator has a front edge concaved backward while the sheath has a front edge convexed backward and forming a continuously closed loop around the front opening in order to engage with and fully cover the front edge of the front insulator such that the front edge of the sheath is seamless around the front opening.

2. The plug set forth in claim 1 wherein an internal surface of the front edge of the sheath is substantially even with an internal surface of the front edge of the front insulator.

3. The plug set forth in claim 1 wherein the base protrudes outward from a rear portion of the sheath, which substantially fits closely around the top insulator and the bottom insulator.

4. The plug set forth in claim 1 wherein the shielding sheet is embedded in a mid-insulator and where the two retention latches are linked to the shielding sheet is encapsulated in two reinforced portions of the mid-insulator, the mid-insulator wedged between the top insulator and the bottom insulator, both the top insulator and the bottom insulator wedged between the two reinforced portions, from each of which a lateral cantilever and a lateral leg of each retention latches respectively protrude forward and backward.

5. The plug set forth in claim 4 wherein each lateral cantilever is embossed with a bulge which is electrically connected to the sheath.

6. The plug set forth in claim 4 wherein the front insulator is also configured to receive every lateral cantilever and a tongue of the receptacle while the two retention latches are adapted to engage with two notches in the receptacle.

7. The plug set forth in claim 4 wherein the front conductive shell further comprises two tabs parallel and adjacent to the two lateral legs, the two tabs extending away from a rear edge of the front conductive shell.

8. The plug set forth in claim 1, further comprising a paddle card, wherein the top legs and the bottom legs are mounted onto the paddle card.

9. The plug set forth in claim 8, further comprising a rear insulator coupled to the base, wherein part of the paddle card particularly where the top legs and the bottom legs are mounted to is encapsulated in the rear insulator.

10. The plug set forth in claim 9 wherein a plurality of solder cups are integrally formed on the rear insulator so as to expose a plurality of rear solder pads on both top and bottom surfaces of the paddle card.

11. The plug set forth in claim 9 wherein the rear insulator is coupled to the base by either a tenon, a mortise, a flange, or a trench integrally formed on the base.

12. The plug set forth in claim 9, further comprising a disparting rack and a cable, a plurality of wires in the cable mounted onto the paddle card, wherein a shield of the cable and the plurality of wires are separated by and rested against the disparting rack.

13. The plug set forth in claim 12, further comprising a filler, wherein part of the disparting rack together with the plurality of wires is considerably encapsulated in the filler.

14. The plug set forth in claim 13, further comprising an inner conductive shell wrapped around the filler and the disparting rack, wherein two arms extend away from the front conductive shell backward until the two arms are coupled to the inner conductive shell.

15. The plug set forth in claim 14 wherein latches formed on the inner conductive shell engage with notches located at the two arms.

16. The plug set forth in claim 14 wherein the disparting rack further comprises two collars for holding the two arms.

17. The plug set forth in claim 14 wherein the shield is pinched between the two arms and the inner conductive shell.

18. The plug set forth in claim 14, further comprising a strain relief and a rear conductive shell, the strain relief formed onto the cable together with a rear part of the inner conductive shell, the rear conductive shell coupled to the base and substantially wrapped around the base and the strain relief.

19. The plug set forth in claim 18 wherein the rear conductive shell is seamless.

* * * * *